US006284172B1

(12) United States Patent
Hume

(10) Patent No.: US 6,284,172 B1
(45) Date of Patent: Sep. 4, 2001

(54) RAPID MOULDING OF LONG CONCRETE POLES

(75) Inventor: Graeme Reginald Hume, Werribee (AU)

(73) Assignee: Hume Brothers Pty Ltd, Werribee (AU)

( * ) Notice: Subject to any disclaimer, the term of this patent is extended or adjusted under 35 U.S.C. 154(b) by 0 days.

(21) Appl. No.: 09/254,174

(22) PCT Filed: Sep. 22, 1997

(86) PCT No.: PCT/AU97/00621

§ 371 Date: Mar. 2, 1999

§ 102(e) Date: Mar. 2, 1999

(87) PCT Pub. No.: WO98/13178

PCT Pub. Date: Apr. 2, 1998

(30) Foreign Application Priority Data

Sep. 23, 1996 (AU) ..... PO 2523/96

(51) Int. Cl.[7] ..... B28B 7/28

(52) U.S. Cl. ..... 264/40.5; 264/86; 264/219; 264/314; 264/333; 425/84; 425/149; 425/175; 425/417

(58) Field of Search ..... 264/40.3, 40.5, 264/86, 314, 333, 335, 87, 219; 425/84, 417, 175, 85, 149; 249/65, 113, 152, 178

(56) References Cited

U.S. PATENT DOCUMENTS

| | | | | |
|---|---|---|---|---|
| 3,809,513 | | 5/1974 | Sellers et al. . | |
| 4,036,922 | * | 7/1977 | Ito et al. | 264/40.3 |
| 4,996,013 | | 2/1991 | Hume . | |

FOREIGN PATENT DOCUMENTS

| | | |
|---|---|---|
| 2137924 | 10/1984 | (GB) . |
| 844335 | 7/1981 | (SU) . |

* cited by examiner

*Primary Examiner*—Mathieu D. Vargot
(74) *Attorney, Agent, or Firm*—Connolly Bove Lodge & Hutz

(57) ABSTRACT

The present invention discloses apparatus for molding an elongate annular product such as a pole, the apparatus including two outer mold sections (1) relatively movable to form in a first position a substantially enclosed upright molding cavity and in a second position opening said molding cavity, an upright core member (3) is moveable into and out of said molding cavity and when located in said molding cavity defining an annular molding zone (37) between the core member (3) and the outer mold sections (1), filling means (5) arranged to fill the annular molding zone (37) from below, and end capping means (6) arranged to close an upper end region of the zone (37), the end capping means (6) including a filter membrane adapted to allow fluids to escape through the filter membrane while fine solid particles are retained within the molding zone (37).

15 Claims, 5 Drawing Sheets

RAPID MOULDING OF LONG CONCRETE POLES

The present invention relates to a method and apparatus for making long concrete poles, particularly for use as power poles.

In British Patent Specification No. 2137924 (instant strip) by the present inventor there is disclosed a process and apparatus for forming an elongate concrete moulded article from high slump concrete wherein surplus liquid is removed through a porous membrane extending around the outer perimeter of the article where the membrane is arranged to provide compression to the concrete within the mould, and thereafter separating the membrane from the surface of the partially dried concrete and removing the article from the mould without significant damage to the cast concrete article. This enables almost immediate reuse of the mould.

A disadvantage of this method is that the external periphery of the concrete article, although visually undamaged, is not smooth. Furthermore, the process disclosed therein cannot be easily utilized by application of a membrane to the internal periphery of the article.

In International Publication No. WO86/07559 (corresponding to U.S. Pat. No. 4,996,013) (Pole Dry) also by the same inventor there is disclosed apparatus and a method of casting annular concrete articles such as poles or pipes. The apparatus and method comprises establishing a suitable mould, defining the desired mould cavity or shape into which wet or uncured concrete is introduced. Thereafter excess water is removed from the concrete by pressing the movable internal liner of the core radially against the concrete in one direction within the mould cavity to pass water therefrom through drainage means associated with the movable internal liner to thereby provide a moulded concrete article having the characteristics of at least a partly cured concrete article whereby the mould and core can be removed from the article for reuse.

Problems have been experienced in the method and apparatus disclosed previously which results from an excess of water in the uppersection of the mould which may lead to improper filling of the mould. This problem appears to be caused by water being segregated from the mix during pumping of concrete into the mould and may occur largely because the composition of the concrete mix is designed to allow water to be readily removed during the moulding procedure described in the above mentioned patents. This excess water must be removed in order to properly fill the mould to produce a satisfactory finished article after removal of water from the mix.

Further problems have been encountered with dean removal of the core due to inadequate clearance between the finished concrete and the movable liner and fitter system against which the concrete is cast.

This latter problem is accentuated in the moulding of lengthy tapered poles such as poles used for power lines, with which the invention is particularly, although not exclusively, concerned.

The inner core incorporates a movable liner comprised of relatively abradant sensitive filter material. Therefore, rubbing or relative movement between the filter material and the concrete should be avoided or at least minimized.

Furthermore it is important that the relative movement of the core and mould and reinforcement cage be minimized during filling of the concrete into the mould space and that the formation of air pockets in the concrete is avoided during the mould filling operation.

It is an objective of the present invention to provide improved moulding methods and apparatus that will minimize some or all of the aforementioned problems associated with production of elongated annular concrete products such as poles. It is a further objective to provide improved parts of moulding apparatus as aforesaid mentioned above.

According to one aspect of the present invention there is provided a method of filling a mould with flowable concrete, the method including positioning a core within at least one outer mould section to form an annular moulding space around the core, capping one upper end region of the annular moulding space in a manner permitting escape of fluids therefrom but retaining solid partides within the annular moulding space, introducing flowable concrete into the annular moulding space from a second end region of the mould until the lowable concrete reaches the upper end of the annular moulding space where fluids escape through the one end region of the annular moulding space and fine cement and sand particles are retained therein. Preferably the method may further include sensing a predetermined pressure rise within the moulding space indicative of solid materials in the flowable concrete reaching the one end region of the moulding space whereupon introduction of flowable concrete to the moulding space is stopped. Conveniently the annular moulding space is disposed in a substantially upright configuration and the predetermined pressure rise is sensed at a position located above halfway up the annular moulding space. More preferably, the pressure rise is sensed at or adjacent the one end region of the moulding space.

In accordance with a further aspect, the present invention also provides a method of moulding an elongated annular concrete product, the method including positioning a core within at least one outer mould section to form an annular moulding space around the core, capping one end region of the annular moulding space in a manner permitting escape of fluids therefrom but retaining solid particles within the annular moulding space, introducing flowable concrete into the annular moulding space from a second end region of the mould until the flowable concrete reaches the one end region of the annular moulding space where fluids escape through the one end region of the annular moulding space and fine cement and sand particles are retained therein, thereafter stopping the flow of concrete to the annular mould space, applying inwardly and outwardly directed radial pressure forces to the concrete located in the annular moulding space while at the same time removing surface fluid drawn to an adjacent surface of the concrete in response to application of the pressure forces; removing the outer mould section or sections and the core from the elongated annular concrete product in the moulding space, at least the core being withdrawn while in a substantially upright configuration. Preferably the method also includes sensing a predetermined pressure rise within the moulding space indicative of solid materials in the flowable concrete reaching the one end region of the moulding space whereupon introduction of flowable concrete to the moulding space is stopped. Conveniently the inwardly and outwardly directed radial pressure forces are applied by each of the core and the or each the outer mould section.

In one preferred embodiment, the radial pressure forces applied by the core and the outer mould sections are removed at the same time in a manner preventing substantial pressure force differentials across the concrete in the mould. In a still further embodiment the core applies pressure forces to the concrete prior to pressure forces being applied by the outer mould sections. In a still further embodiment the outer mould sections apply pressure forces to the concrete prior to the core applying pressure forces to the concrete, the pressure forces applied by the outer mould section being initially removed prior to removal of pressure forces applied by the core.

According to a second aspect of the present invention there is provided apparatus for moulding an elongated annular concrete product, the apparatus including at least two outer mould sections relatively movable to form in a first position a substantially enclosed moulding cavity and in a second position opening the moulding cavity, a core member movable into or out of the moulding cavity and when located in the moulding cavity defining an annular moulding zone between the core member and the outer mould sections, filling means arranged to fill the annular moulding zone with flowable concrete from a first end region of the annular moulding zone, and end capping means arranged to close a second end region of the annular moulding zone, the end capping means being cooperable with the second end region of the annular moulding zone to permit fluids to flow therefrom while retaining fine solid particles such as cement and sand within the annular moulding zone, and means to remove the core from the moulding cavity while in a substantially upright position.

According to a third aspect the present invention provides a core member which may be capable of use in the aforesaid moulding apparatus, the core member including an inner member and an outer liner member adapted for selective movement radially outwardly relative to the inner member, the inner member being movable selectively in a longitudinal direction relative to the liner member.

In accordance with a fourth aspect, the present invention provides a core member which may be capable of use in the aforesaid moulding apparatus, the core member including an inner member and an outer liner member adapted for selective movement radially outwardly relative to the inner member, the outer liner member being constructed of polymeric material or materials and formed by first circumferentially extendable sections interspaced by second substantially circumferentially unextendable sections whereby the selective radially outward movement of the outer liner member is achieved by selectively extending the first sections. Conveniently each the second section carries outwardly a filter membrane adapted to allow fluids to pass therethrough while retaining fine solid particles, each the second section further including at least one drainage passage communicating with an outer surface of the second section to allow fluid passing through the filter membrane to flow into the drainage passage. Conveniently each the first section in an unextended state is preformed to include a portion extending radially outwardly beyond the outer radial position of the filter membrane carried by the second sections.

In accordance with a fifth aspect, the present invention also provides apparatus for carrying out a method of moulding a lengthy concrete pole including a substantially upright core and mould section forming an annular moulding zone adapted to be filled with flowable concrete wherein the core and the mould section are relatively located by retractable location means engaging the core and the mould section during introduction of the flowable concrete into the moulding zone but being withdrawn after introduction of the flowable concrete into the moulding zone.

The invention will be described in greater detail having reference to preferred embodiments Illustrated in the accompanying drawings. in which:

FIG. 1 and FIGS. 1*a*–1*h* hereinafter collectively referred to as "FIG. 1") are schematic flow diagrams showing the various stages of the process of manufacturing a tapered concrete pole;

FIG. 2*a* is a partial transverse sectional view of an upper end of the mould liner construction showing the liner in retracted and expanded positions;

FIG. 2*b* is a view similar to FIG. 2*a* but at a lower end of the mould construction;

Figure 5:
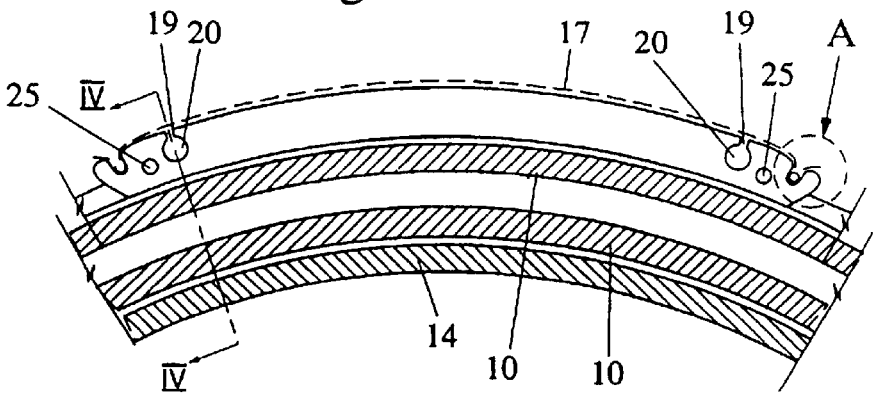
FIG. 5 is a part section view taken along line V–V of FIG. 4.
Figure 4:
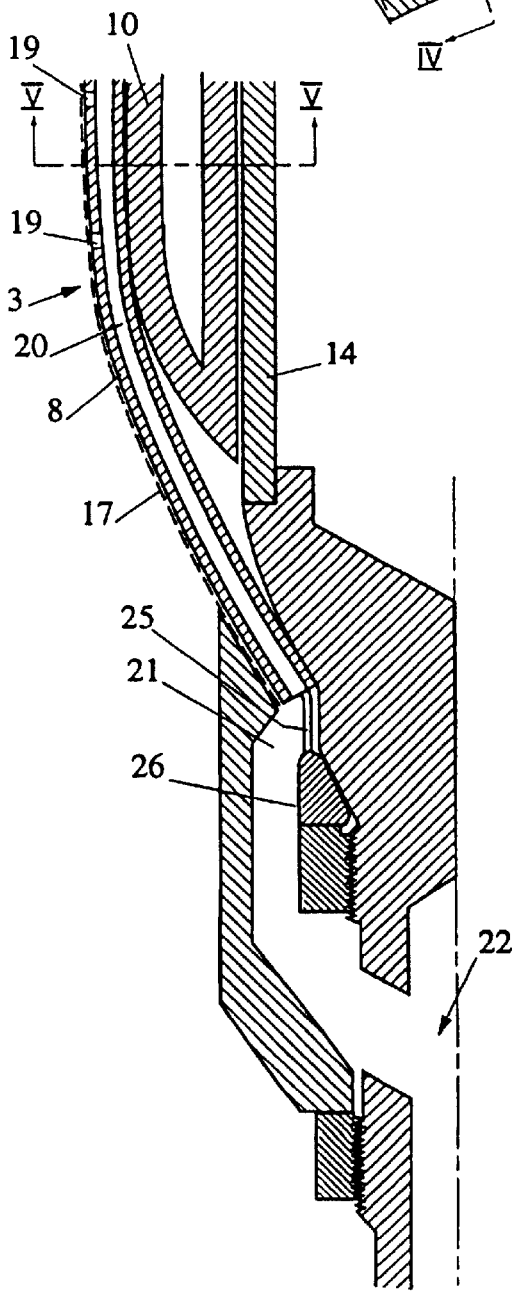
FIG. 4 is a part sectional detail view taken along line IV–IV of FIG. 5 showing the foot of the core member including its associated liner.
Figure 5A:
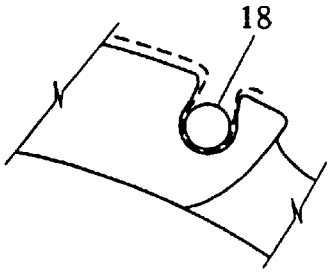
Figure 5B:
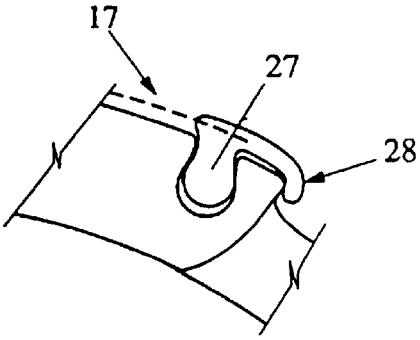

FIG. 5*a* is a detail view of the area A of FIG. 5;

FIG. 5*b* is a detail view showing a possible alternative to the arrangement shown in FIG. 5*a;*

Figure 6:
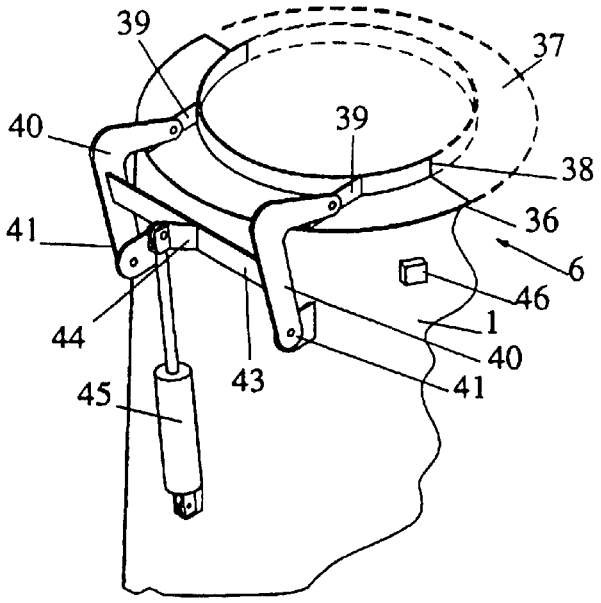
Figure 7:
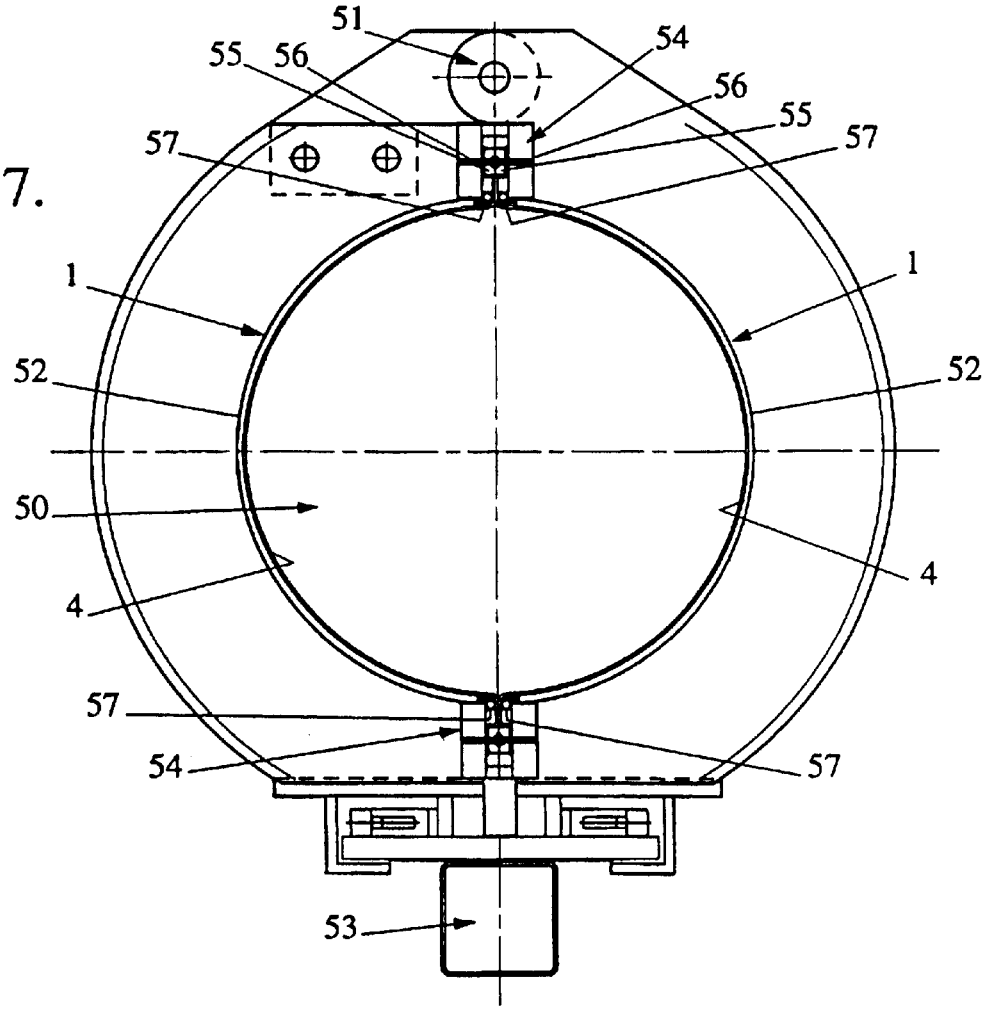

FIG. 6 is a partial perspective view showing one preferred from of end cap arrangement for the mould; and FIG. 7 is a schematic cross-sectional view of two outer mould half shells.

The mould according to the preferred embodiment of this invention comprises two outer mould half shells 1 each having a liner 4 constructed and operated in a manner similar to that disclosed in U.S. Pat. No. 4,996,013. The outer mould half shells 1, when engaged together define a mould cavity 50 with the inner surface forming the outer surface of the product to be formed which as described below may be a tapered reinforced concrete pole. FIG. 7 illustrates one practical form of the outer mould half shells 1 which are hinged together about a generally vertical pivot axis 51, the closed position being illustrated in the drawing. Each mould half shell includes an outer steel shell 52 and the inner liner 4 is connected thereto only about its perimeter leaving a space between the liner 4 and the steel shell 52 for the selve introduction of pressurized air there between. In the closed position, a locking bar 63 is actively engaged to ensure the half shells 1 remain in the closed position. Conveniently on both skies of the mould half shells 1, longitudinal mould joints 54 are provided with liner clamping bars 55 which together with screws 56 clamp or fix the ends of the liners 4 to the mould joints 54. Hollow rubber extrusions 57 provide a seal between the liners 4 by introducing hydraulic or pneumatic pressure into the hollow extrusions to press the liners together. To open the mould half shells, the locking bar 53 is released to allow the half shells 1 to be pivoted about the hinge 51. An inner core 3 is adapted to be moved into the mould cavity defined by the outer mould half shells 1 so as to form an annular moulding zone surrounding the inner core 3. The upper end of the annular moulding zone is closed by an end cap 6 with high slump concrete being delivered to the annular moulding zone via a delivery fitting 5 located below the mould and a pump (not shown).

The construction of the core member 3 is shown in greater detail in FIGS. 2 to 5. The core member 3 includes a liner 8 with different segments 23 and 24 of differing materials. In one embodiment, the segments 23,24 may be made of thermoplastic material such as that which is commercially available under the trade name "Santoprene"™. The segment 23 is desirably relatively less flexible than the segment 24 and this may be achieved by segment 23 having a greater hardness of approximately 55 Shore D and the segment 24 having hardness of approximately 65 Shore A. Conveniently the segment 23 is relatively stiff and the segment 24 is relatively flexible and this may be achieved by using the same material for both segments utilizing a thicker section for the segment 23 compared to that of the segment 24 or alternatively, different materials as noted above can be used. Construction of the liner 8 can be by separately producing the segments 23 and 24, for example by extrusion, with segment 23 being cut on the bias and welded to segment 24 along weld lines 30 to produce the desired tapered configuration. Alternatively the segments 23 and 24 could be coextruded, either from the same or differing thermoplastics materials, to form an integral construction for the liner 8.

The liner 8 is constructed to surround in annular fashion, a member 10 mounted to move longitudinally on an inner longitudinally extending member 14. The outer surface of the member 10 is tapered corresponding generally to the taper of the product to be moulded. The upper end of the liner 8 is connected to a rigid housing part 31 defining a zone 11 above the member 10 (see FIG. 3).

Figures 2A, 2B:
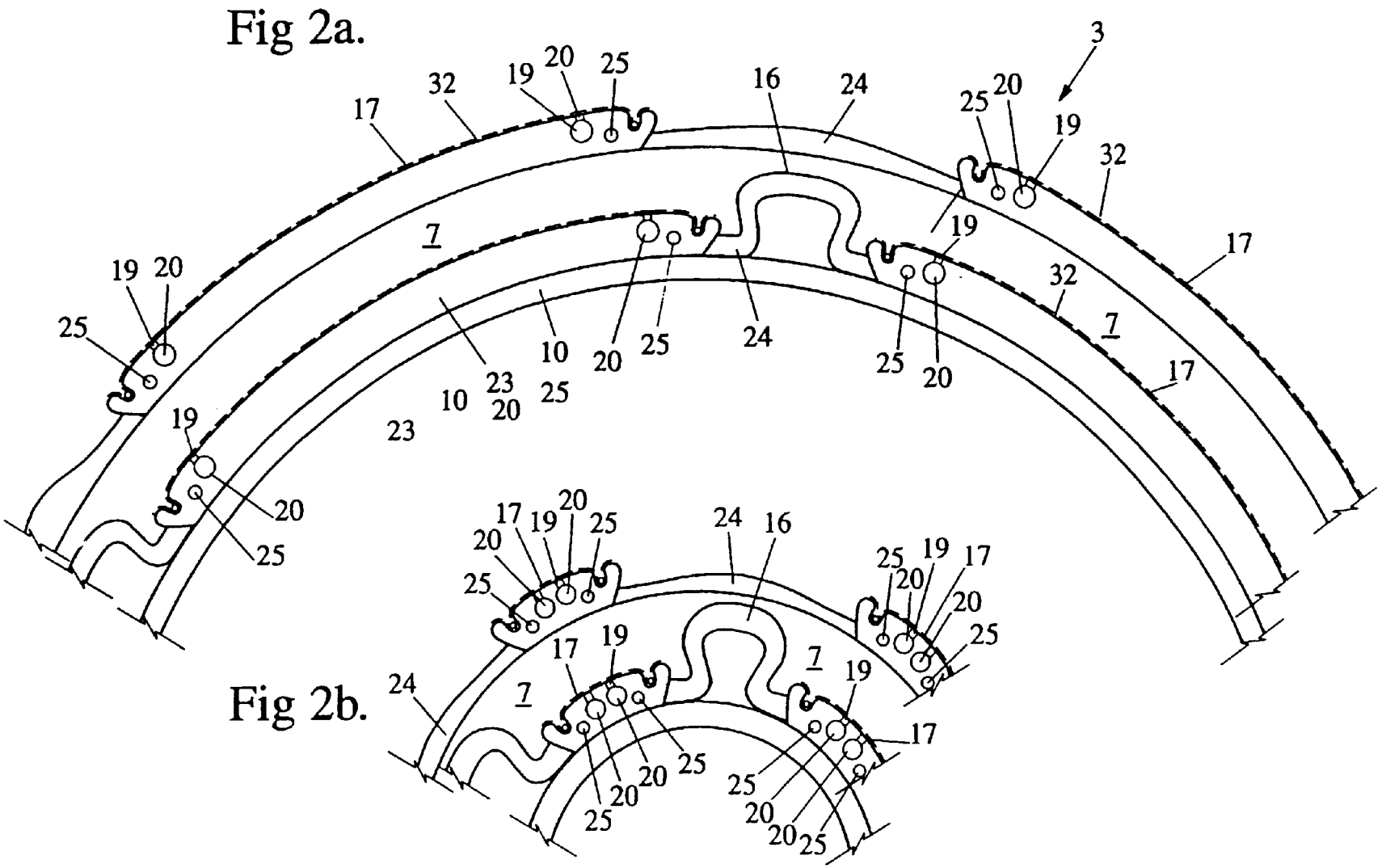
Figure 3:
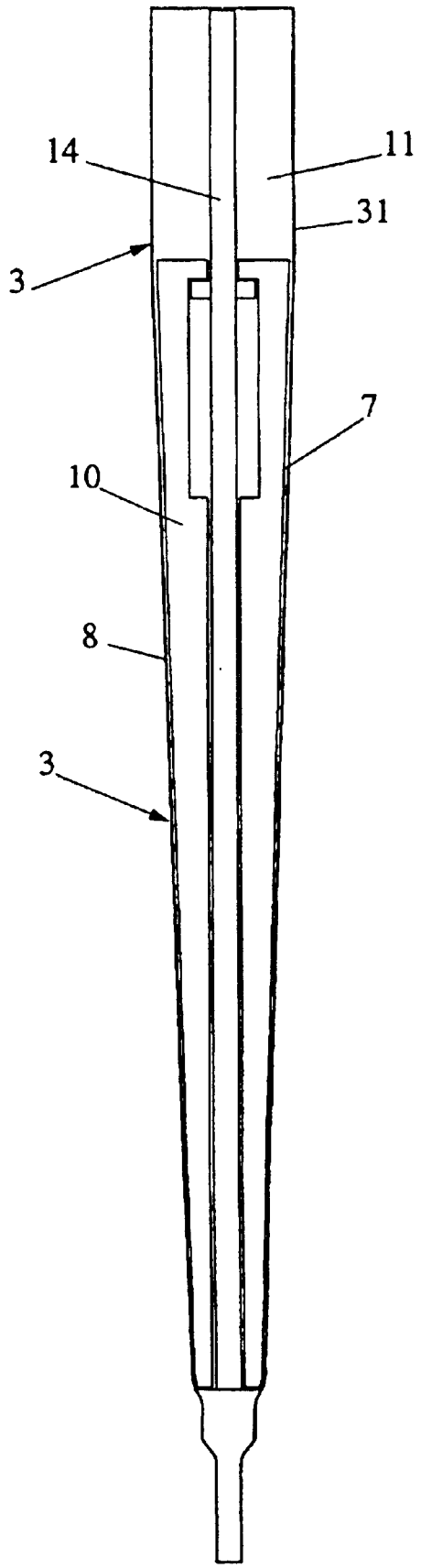
FIG. 3 is a schematic sectional side view showing the core member.

Referring now to FIGS. 2*a* and 2*b*, the liner 8 is formed by a plurality of segments 23, each separated from another segment 23 by a segment 24. Each segment 23 has at least one and preferably two or more drain holes 20 passing from the upper end to the lower end of the segment 23 with the drain holes 20 being connected to an outer surface 32 of the segment by a plurality of transverse drainage openings 19. Further a reinforcing cord or cords 25 of a strong polyethylene (or similar material) is/are provided extending the length of the segment 23 and are connected at their lower ends to an anchor ring 26 (FIG. 4) to prevent the liner 8 from lifting during pumping of high slump concrete into the annular moulding zone. The lower position of the liner 8 identified at 8' in FIGS. 2*a* and 2*b* show the liner segments 23 and 24 engaged against the member 10 and the segment 24 in its undeformed state which is hat shaped in cross-section. In this state, the segment 24 has a radially outer surface portion 16 that extends radially outwardly beyond the segment 23. If pressurized air is introduced into the space 7 between the liner 8 and the member 10, the liner is expanded outwardly to the second position 8" illustrated where the segment 24 straightens circumferentially to provide the increased circumferential length of the liner 8. In moving to the position 8", the liner segment 23 does not substantially lengthen in a circumferential direction.

Overlying each liner segment 23 is a filler membrane or cloth 17 (which may be of natural or synthetic fiber) which is fixed to the segment 23 around its peripheral edges (i.e. top, bottom and both sides). FIGS. 5, 5*a* and 5*b* illustrate two alternative convenient means for fixing the filter membrane 17 to the segment 23. In FIG. 5*a*, the membrane 17 is held within a peripheral groove 18 via a beading element 33. In FIG. 5*b*, the filter membrane 17 is fastened to an extrusion element 28 which includes a beading section 34 and a lever section 35 adapted to ease in releasing the filter membrane 17 for replacement when required.

FIG. 6 illustrates an end cap arrangement 6 for closing an upper end of the annular mould zone 37 formed by the outer mould half shells 1 and the core 3. It will of course be appreciated that an end cap arrangement 6 as illustrated in FIG. 6 will be provided attached to each outer mould half shell to provide a complete mould end closure. Each end cap arrangement comprises a frame member 36 defining a half annular shape with an internal liquid flow zone 37 preferably covered by a filter membrane material of a similar type to the filter membrane 17 of the core 3. This arrangement (when in a closure position) permits liquid to flow from the annular mould zone 37 but retains the fine cement, sand and other solids within the annular mould zone. The frame member 36 includes an inner half circular flange 38 that in the closure position engages against the housing part 31 of zone 11 of the inner core 3. The frame member 36 further includes web flanges 39 extending from the flange 38 to an outer portion of the frame member 36 and to which operating arms 40 are pivotally connected at an intermediate location. The operating arms 40 are formed as an elbow with their lower ends 41 pivotally connected to a mounting 42 on the outer half shells 1. A connecting arm 43 connects the two operating arms 40 and includes a central lever arm 44 that is pivotally connected to an actuating cylinder 45, the lower end of which is pivotally connected to the half shells 1. In the position illustrated in FIG. 6. the end cap arrangements 6 closes the upper end of the moulding zone 37 with the actuating cylinder 45 extended providing the required hold down or closure clamping force. If the cylinder 45 is retracted from the illustrated closure position, the frame member 36 is lifted and pivoted outwardly to free the upper end of the annular moulding zone 37. Finally, it is desirable to include a pressure transducer 46 arranged to sense a pressure rise of a predetermined size within the moulding zone 37 indicative of solid materials within the flowable concrete engaging against the end cap arrangement 6. The pressure rise may be sensed in the top half of the moulding zone 37 or more preferably at or adjacent the upper end of the annular moulding zone 37. The transducer 46 may be mounted from one of the outer half shells 1 or may perhaps be mounted from the end cap arrangement 6. The purpose of the pressure transducer 46 is to sense a predetermined pressure rise indicative that the mould zone 37 has been completely filled with concrete.

Figures 1, 1A, 1B, 1C, 1D, 1E, 1F, 1G, 1H:
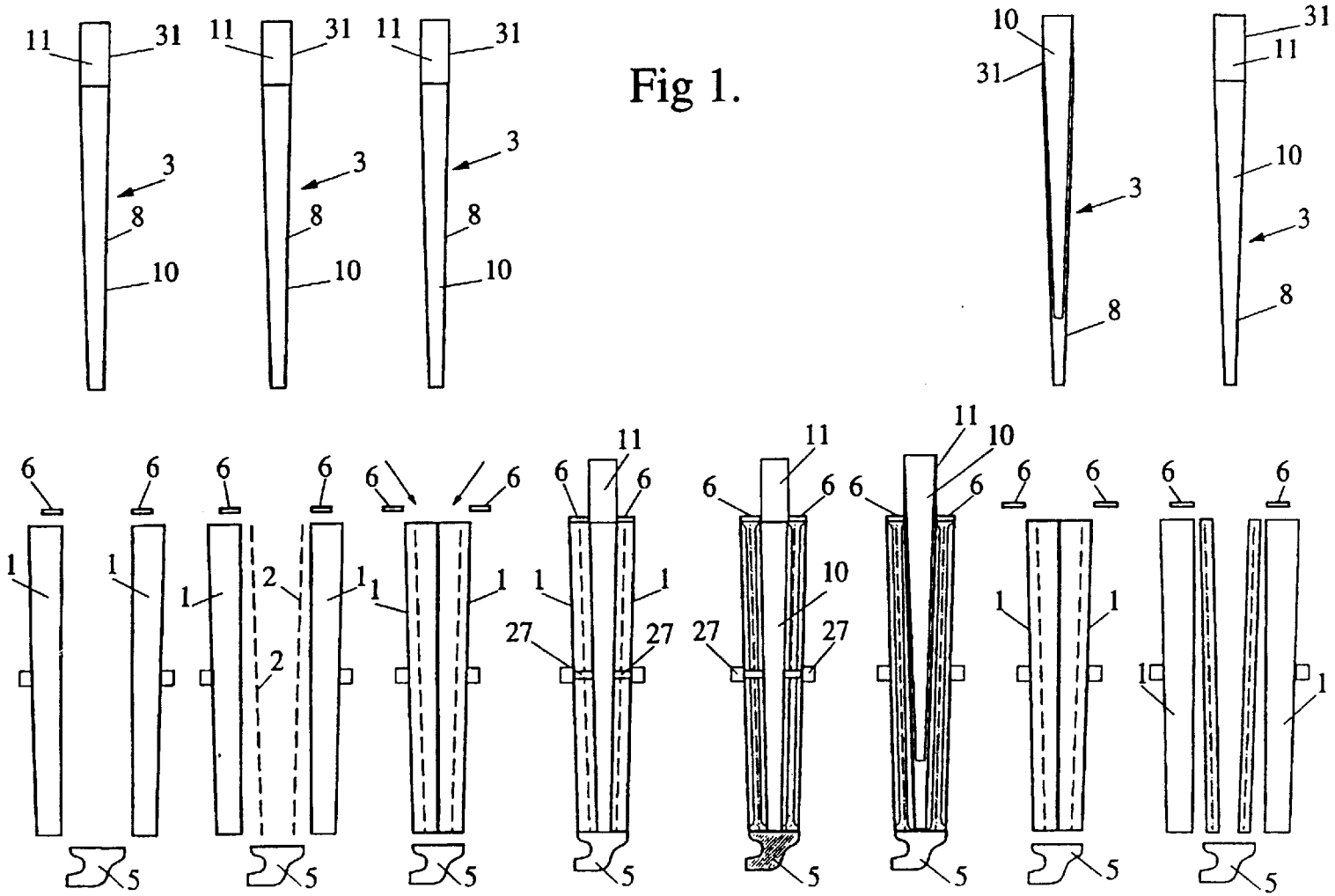

Reference will now be made to FIG. 1 which shows diagrammatically a sequence of events in moulding a tapered concrete pole in accordance with the present invention.

Initially the mould hag shells 1 with their associated liners 4 are placed vertically with the core 3 disposed above the internal mould cavity to be formed by the mould (FIG. 1*a*). In this configuration the end cap arrangements 6 are also laterally spaced from the internal mould cavity. With the mould configuration in this initial open commencement position, an annular tapered reinforcement cage 2 can be positioned in the mould cavity (FIG. 1*b*). The mould half shells 1 are then moved inwardly toward one another (FIG. 1*c*) to partially close the mould with the core 3 thereafter being lowered into position within the mould cavity. The end cap arrangements 6 may then be moved to close the upper end of the mould cavity 37 with the filler elbow being moved to close the lower end of the mould cavity 37 (FIG. 1*d*).

As is also shown in FIG. 1*d*, retractable locater pins 27 connected to the mould half shells 1 may be extended radially inwardly to engage and locate the core 3 to maintain the core 3 in its desired concentric relationship relative to the outer mould half shells 1 during the concrete filling stages of the procedure. The retractable pins 27 are withdrawn after the concrete filling stage so as not to leave holes or discontinuities in the pole product formed.

In the closed position of the mould (FIG. 1*d*), it is preferred that vacuum be applied to the liners 4 to draw them outwardly against the mould half shells 1 to remove or minimize the gap between the liner and the mould. Thereafter high slump concrete is pumped into the mould cavity 37 from the bottom through the filling elbow 5. Depending upon the concrete mix parameters, the pumping pressures may cause segregation resulting in an excess of water (carrying cement and other fine partides including sand) on top of the concrete as it rises in the mould cavity. The escape of the material carried in this water is prevented via the end cap arrangements 76 previously described. Moreover, once the pressure transducer 46 determines, via a predetermined sensed pressure rise, that the mould cavity 37 is completely filled, a valve in the filling elbow 5 is closed thus completely containing the concrete. Once this occurs, pressurized air (approximately 3 Mpa) is applied to the cavity 11 at the upper end core 3 which not only holds the member 10 in its lower position (FIG. 3) but also applies the air pressure to the gap 7 between the liner 8 and the member 10. This drives the liner 8 carrying the filter membrane 17 radially outwards to compress the concrete in the cavity 37. The pressure applied to the liner 8 causes water to be squeezed radially inwardly through the filter membrane 17 to be collected through holes 19 in the vertical drain tubes 20. The water travels through the drain tubes 20 to a collection manifold 21 and thereafter through a discharge pipe 22 for recycling. As the water is released the volume of the concrete is reduced resulting in a reduction of the wall thickness of the product being moulded. While pressure is being maintained on the inner liner 8, an equal pressure is applied to the liner membrane 4 (as disclosed in U.S. Pat. No. 4,996,013). In a possible alternative arrangement, it is possible to apply pressure to the concrete firstly via the outer liner 4 and then via the inner liner 8, however, if this is done the pressure behind the outer liner 4 should be released to allow the concrete to reconform to the shape of the outer mould (1). This ensures the final dimensional accuracy of the moulded product and further maximizes the clearance between the member 10 and the inner liner 8 to assist with withdrawal of the core 3.

Once the moulding processes are complete (FIG. 1*e*), pressure is withdrawn from the cavity 7. It is desirable that pressures on both the liners 4 and 8 be released at the same time and at the same rate to minimize pressure differentials across the moulded concrete section that might result in cracking of the moulded product. With pressure in the cavity 7 at either atmospheric or at a slightly vacuum pressure, the liner 8 will withdraw from the inner surface of the concrete by contraction of the segments 24 of the liner 8 returning to their normal (as extruded) configuration. This process is further aided by movement or retraction of the member 10 (FIG. 1*f*) into the upper housing part 31 of the core 3 thereby increasing the space between the surface of the member 10 and the inner surface of the moulded concrete. In this state, the contracted segments 24 present radially outer portions 16 that will protect the filter membrane material 17 from being abraded as the core 3 is withdrawn. The cast product is now ready to be stripped (FIGS. 1*g* and 1*h*) where the end cap arrangements 6 and the filling elbow 5 are withdrawn. The inner core 3 is then withdrawn. Once the inner core 3 is raised, low pressure air is conveniently applied to the cavity 7 and the member 10 is lowered back to its operable position within the core 3 (FIG. 1*h*) ready for the next casting operation. Before opening the mould half shells 1, large air passages are conveniently opened to allow air into the cavity to be formed between the mould half shells 1 and the liner 4. As a mould lock is being released, air is allowed to freely enter this cavity, this preventing sections of concrete being sucked off the product. On release, the moulded product is supported by the reinforcement cage 2 around which it has been cast.

The claims defining the invention are as follows:

1. A method of moulding an elongated annular concrete product, said method including positioning a core within at least one outer mould section to form an annular moulding space around said core, capping one end region of the annular moulding space in a manner permitting escape of fluids therefrom but retaining solid particles within the annular moulding space, introducing flowable concrete into said annular moulding space from a second end region of said mould until said flowable concrete reaches said one end region of the annular moulding space where fluids escape through said one end region of the annular moulding space and fine cement and sand are retained therein, sensing that solid materials in said flowable concrete have reached said one region of the moulding space where upon introduction of flowable concrete to said moulding space is stopped, applying inwardly and outwardly directed radial pressure forces to the concrete located in said annular moulding space while at the same time removing surface fluid drawn to an adjacent surface of the concrete in response to application of said pressure forces; removing said outer mould section or sections and said core from the elongated annular concrete product in said moulding space, at least said core being withdrawn while in a substantially upright configuration.

2. A method according to claim 1 wherein said inwardly and outwardly directed radial pressure forces are applied by each of said core and the or each said outer mould section.

3. A method according to claim 2 wherein the radial pressure forces applied by said core and said outer mould section or sections are removed at the same time in a manner preventing substantial pressure force differentials across the concrete in the moulding space.

4. A method according to claim 2 wherein said core applies pressure forces to said concrete prior to pressure forces being applied by said outer mould section or sections.

5. A method according to claim 2 wherein said outer mould section or sections apply pressure forces to said concrete prior to said core applying pressure forces to said concrete, said pressure forces applied by said outer mould section or sections being initially removed prior to removal of pressure forces applied by said core.

6. Apparatus for moulding an elongated annular concrete product, said apparatus including at least two outer mould sections relatively movable to form in a first position a substantially enclosed moulding cavity and in a second position opening said moulding cavity, a core member movable into or out of said moulding cavity and when located in said moulding cavity defining an annular moulding zone between said core member and said outer mould sections, filling means arranged to fill said annular moulding zone with flowable concrete from a first end region of said annular moulding zone, and end capping means arranged to close a second end region of said annular moulding zone, said end capping means cooperating with the second end region of the annular moulding zone to permit fluids to flow therefrom while retaining fine solid particles within said annular moulding zone, pressure sensing means arranged to sense a predetermined pressure rise within a half of the moulding zone adjacent said second end region, said predetermined pressure rise being indicative of solids of the flowable concrete engaging against the end capping means, and control means being provided to prevent flow of concrete into said moulding zone when said predetermined pressure rise is sensed, and means to remove said core from said moulding cavity while in a substantially upright position.

7. Apparatus according to claim 6 wherein said end capping means includes a filter membrane adapted to allow fluids to escape through said filter membrane while said fine solid particles are retained within the annular moulding zone.

8. Apparatus according to claim 6 wherein said pressure sensing means is located at or near the second end region of the moulding zone.

9. Apparatus according to claim 6 wherein each of said outer mould sections and said core member carry liner members which are adapted to be selectively moved radially towards the annular moulding zone to apply radial pressure forces to concrete located in said annular moulding zone.

10. Apparatus according to claim 9 wherein the core member comprises an inner member and a said inner member located outwardly of said inner member, said inner member being movably arranged relative to said liner member whereby said inner member can be selectively moved in a longitudinal direction at least partially out of said annular moulding zone prior to moving said liner member from said annular moulding zone.

11. Apparatus according to claim 9 or wherein the liner member carried by said core member is formed by first circumferentially extendable sections interspaced by second substantially circumferentially unextendable sections whereby the radial pressure forces are applied to concrete within said annular moulding zone by selectably extending circumferentially said first sections.

12. Apparatus according to claim 11 wherein each said second section carries outwardly a filter membrane adapted to allow fluids to pass therethrough while retaining fine solid particles, each said second section further including at least one drainage passage communicating with an outer surface of the second section to allow fluid passing through the filter membrane to flow into said drainage passage.

13. Apparatus according to claim 12 wherein each said first section in an unextended state is preformed to include a portion extending radially outwardly beyond the outer radial position of the filter membrane carried by said second sections.

14. Apparatus according to claim 9 wherein the liner member carried by said core member is formed from a polymeric material or materials.

15. Apparatus according to claim 6 wherein retractable location means are provided intermediate the upper and lower ends of the outer mould sections to locate said core member centrally within said moulding cavity, said location means being extendable while flowable concrete is introduced into said annular moulding zone but being retracted once the annular moulding zone is filled with said concrete.

* * * * *

UNITED STATES PATENT AND TRADEMARK OFFICE

CERTIFICATE OF CORRECTION

PATENT NO. : 6,284,172 B1
DATED : September 4, 2001
INVENTOR(S) : Graeme R. Hume It is certified that error appears in the above-identified patent and that said Letters Patent is hereby corrected as shown below:

Column 7,
Line 3, change “Mpa” to -- Bar --

Signed and Sealed this

Twelfth Day of April, 2005

JON W. DUDAS
*Director of the United States Patent and Trademark Office*